US005109663A

United States Patent [19]

Stahlecker et al.

[11] Patent Number: 5,109,663

[45] Date of Patent: * May 5, 1992

[54] ARRANGEMENT FOR OPEN END ROTOR SPINNING

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[ * ] Notice: The portion of the term of this patent subsequent to Nov. 19, 2008 has been disclaimed.

[21] Appl. No.: 530,315

[22] Filed: May 30, 1990

[30] Foreign Application Priority Data

Jun. 2, 1989 [DE] Fed. Rep. of Germany ..... 3917991

[51] Int. Cl.[5] ..... D01H 4/00

[52] U.S. Cl. ..... 57/407; 57/411; 57/413; 57/415

[58] Field of Search ..... 57/300-301, 57/302, 304, 400, 404, 406, 407, 408, 411, 413, 414, 415, 416

[56] References Cited

U.S. PATENT DOCUMENTS

| | | | |
|---|---|---|---|
| 3,368,340 | 2/1968 | Barsukov et al. | 57/411 |
| 3,511,044 | 5/1970 | Stary | 57/411 |
| 3,624,995 | 12/1971 | Rajmoha et al. | 57/414 X |
| 3,837,153 | 9/1974 | Didek et al. | 57/415 X |
| 3,908,349 | 9/1975 | Urifu et al. | 57/414 |
| 4,036,002 | 7/1977 | Kobayashi | 57/301 X |
| 4,058,964 | 11/1977 | Stalder | 57/416 |
| 4,384,451 | 5/1983 | Elias et al. | 57/301 X |
| 4,459,800 | 7/1984 | Stahlecker | 57/413 X |
| 4,483,135 | 11/1984 | Kurushima et al. | 57/301 |
| 4,489,547 | 12/1984 | Kawabata et al. | 57/415 |
| 4,510,745 | 4/1985 | Kawabata et al. | 57/302 X |
| 4,731,987 | 3/1988 | Jaros et al. | 57/414 X |
| 4,858,423 | 8/1989 | Stahlecker | 57/413 |
| 4,903,474 | 2/1990 | Stahlecker | 57/415 X |

FOREIGN PATENT DOCUMENTS

| | | |
|---|---|---|
| 2615505 | 10/1977 | Fed. Rep. of Germany . |
| 3120877 | 12/1982 | Fed. Rep. of Germany . |
| 3704460 | 8/1988 | Fed. Rep. of Germany . |
| 3730706 | 3/1989 | Fed. Rep. of Germany . |

*Primary Examiner*—Daniel P. Stodola
*Assistant Examiner*—Michael R. Mansen
*Attorney, Agent, or Firm*—Evenson, Wands, Edwards, Lenahan & McKeown

[57] ABSTRACT

In an arrangement for open-end rotor spinning having an opening roller, a spinning rotor and a fiber feeding duct connecting the opening roller and the spinning rotor, it is provided that the fiber collecting groove has a diameter of maximally 33 mm, that the mouth of the fiber feeding duct amounts to maximally 20 mm$^2$, that the fiber feeding duct, on the outside of the spinning rotor, is provided with a bypass opening, and in that the rotor is provided with ventilating bores.

8 Claims, 1 Drawing Sheet

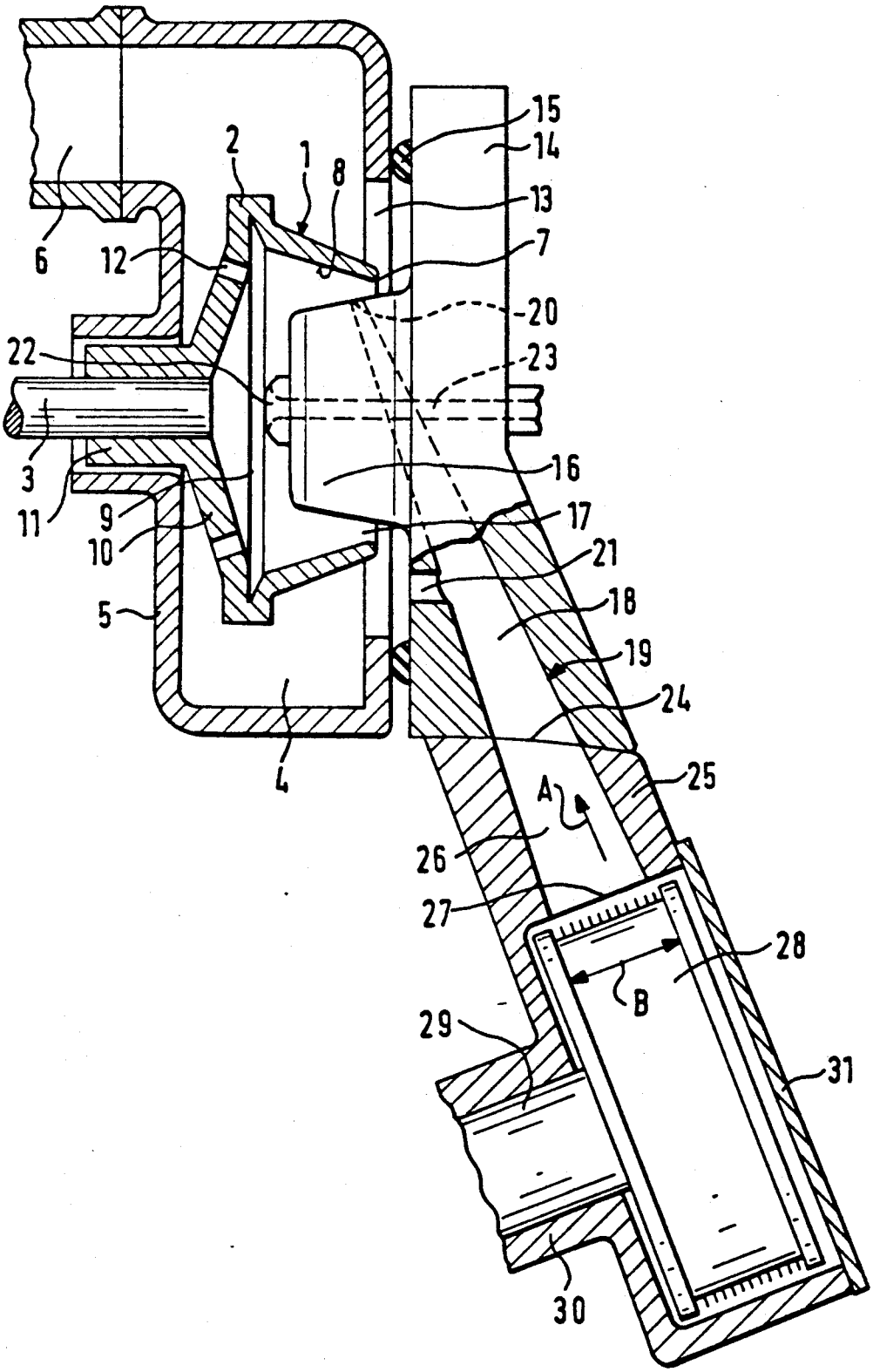
15
14
13
7
20
23
16
17
21
18
19
24
25
A
26
27
28
B
29
31
30
2
1
8
6
12
22
3
11
9
10
5
4

ARRANGEMENT FOR OPEN END ROTOR SPINNING

BACKGROUND AND SUMMARY OF THE INVENTION

The invention relates to an arrangement for open-end rotor spinning including an opening roller, a spinning rotor and having a fiber feeding duct connecting the opening roller and the spinning rotor. The fiber feeding duct starts at the circumference of the opening roller with a cross-section adapted to the working width of the opening roller and tapers to its mouth which is disposed opposite a sliding surface of the spinning rotor which expands conically toward a fiber collecting groove which is followed by a rotor bottom by means of which the rotor is fastened on a shaft. The mouth of the fiber feeding duct is disposed in a projection projecting into the rotor, this projection, together with the open edge of the rotor, forming an overflow gap for the transport air and being part of a cover which covers a rotor housing receiving the rotor and connected to a vacuum line.

For a perfect rotor spinning operation, it is endeavored that the fibers fed in the fiber feeding duct arrive on the sliding wall of the rotor, on the one hand, at a sufficient distance from the fiber collecting groove and, on the other hand, also at a sufficient distance from the open end.

As a result, it is to be achieved that a sufficient path is available on the sliding surface so that during their movement toward the fiber collecting groove, the fibers can still be drawn. On the other hand, it is to be avoided that the fibers are taken along by the transport air flowing off over the open rotor edge. In modern open-end rotor spinning machines, there is a tendency toward progressively higher rotor speeds and at the same time progressively smaller spinning rotors. Spinning rotors are currently known which have a diameter in the area of the fiber collecting groove of less than 36 mm. Because of these small dimensions, the maintaining of the above-mentioned conditions becomes more difficult. It should be endeavored to guide the fibers as precisely as possible to one point; i.e., in an almost punctiform manner. This requires a very small mouth for the fiber feeding duct. However, as a result of a small mouth of the fiber feeding duct, the amount of air that can be taken in diminishes so that difficulties arise during the fiber transport and the risk occurs that dirt remains hung up particularly in the starting area of the fiber feeding duct. In addition, the overflow gap between the insert and the open rotor edge becomes smaller so that increased flow rates of the flowing-off air occur there which increases the danger of a taking-along of fibers.

In order to solve some of the described problems, it has been contemplated according to German Published Examined Patent Application (DE-A) 37 04 460 to enlarge the mouth of the fiber feeding duct in the circumferential direction of the spinning rotor, but to keep it as small as possible in the axial direction, i.e., in the longitudinal direction of the sliding surface of the rotor.

It has also been contemplated according to German Published Examined Patent Application (DE-A) 37 30 706 to open up the fiber feeding duct starting from the mouth area opposite the sliding surface by means of a lateral slot so that the cross-section determining the taken-in amount of air is placed from the mouth back into an area with a larger cross-section.

It has been contemplated according to German Published Examined Patent Application (DE-A) 31 20 877 to prevent or at least limit a depositing of fine dirt particles, particularly dust, in the rotor, by separating the transport air flow from the fibers before the entry into the spinning rotor and discharging it. The fine particles, which have a smaller mass than the fibers, are taken along by the transport air flow.

It has been contemplated according to German Published Examined Patent Application (DE-A) 26 15 505 to provide ventilating bores in the rotor bottom of the rotor of the spinning rotor, the axes of the ventilating bores extending approximately in parallel with respect to the axis of the spinning rotor. These ventilating bores have the purpose of influencing the pressure conditions in the interior of the spinning rotor and thus also the flow conditions.

It is an object of the invention to provide an arrangement for open-end rotor spinning of the initially mentioned type in which, without any significant increase of the vacuum, a sufficient amount of air is taken in also in the case of small spinning rotors and in which nevertheless a strong bundling of the fed fibers is obtained without the arising of any problems with respect to the removal of the transport air.

This object is achieved according to preferred embodiments of the invention in that the fiber collecting groove of the rotor has a diameter of maximally 33 mm, in that the mouth of the fiber feeding duct has a cross-section of maximally 20 $mm^2$, in that the fiber feeding duct, in an area located outside the rotor, is provided with at least one bypass opening connected to a vacuum source, and in that the rotor bottom is provided with ventilating bores.

By means of this combination of characteristics, it is achieved that the fibers are bundled well by means of a very small mouth of the fiber feeding duct. In this case, not all transport air taken in at the opening roller must flow through the mouth of the fiber feeding duct because part of this transport air is sucked off through the bypass opening. The amount of transport air to be removed from the spinning rotor is therefore reduced which leads to slower speeds in the overflow gap. As a result of the additional ventilating bores in the spinning rotor, it is achieved that the amount of air to be removed by way of the overflow gap is reduced further.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a schematic partial vertical sectional view of an open-end rotor spinning unit, constructed in accordance with a preferred embodiment of the invention.

DETAILED DESCRIPTION OF THE DRAWINGS

The shown spinning rotor assembly 1 comprises a rotor 2 and a rotor shaft 3. The shaft 3 is disposed and drivable in a manner not shown in detail. The rotor 2 is disposed in a vacuum chamber 4 which is formed by a rotor housing 5. The rotor housing 5 is connected to a vacuum source which is not shown by means of a vacuum pipe 6.

The rotor 2 has an open end 7 where a sliding surface 8 starts which expands in the manner of a truncated cone to form a fiber collecting groove 9 which has the largest inside diameter. This inside diameter amounts to maximally 33 mm. A rotor bottom 10 connects to the fiber collecting groove 9 and is provided with a collar-type projection 11 by means of which the rotor 1 is fastened on the shaft 3, particularly pressed onto the shaft 3. The rotor bottom 10 is provided with several ventilating bores 12, for example, with six ventilating bores which are uniformly arranged on a common diameter. These ventilating bores 12 are located in the transition area between a radial surface of the fiber collecting groove 9 and the rotor bottom 10 which tapers in the shape of a truncated cone at an obtuse angle of taper toward the projection 11. The axes of the ventilating bores 12, with a slight slope, are inclined such with respect to the axis of rotation of the rotor 2 that their start which begins on the interior of the rotor 2 is located on a smaller radius than their end located on the outside at the rotor bottom 10. As a result, the ventilating bores 12 are provided with a ventilating effect, i.e., a delivery effect from the inside of the rotor 2 to the outside.

In the area assigned to the open end 7 of the rotor 2, the rotor housing 5 is provided with an opening 13 which is dimensioned such that the rotor 2 and therefore the whole spinning rotor assembly 1 can be removed through this opening 13. A cover 14 is assigned to the opening 13 by means of which the rotor housing 5 is closed during the operation. The cover 14 rests against the rotor housing 5 with the insertion of a sealing ring 15.

The cover 14 is provided with a projection 16 which is slightly truncated-cone-shaped and which projects into the interior of the rotor 2. Together with the open end 7 of the rotor 2, the projection 16 forms an annular overflow gap 17 through which part of the transport air flows off by means of which fibers are transported into the rotor 2. This fiber transport takes place through a fiber feeding duct 19 which starts at the circumference of an opening roller 28.

The opening roller 28 is disposed in an opening roller housing 30 by means of a bearing 29. Its drive, in a manner not shown in detail, takes place by way of a projection projecting out of the bearing 29 on the side opposite the opening roller 28. The opening roller housing 30 is closed by means of a cover 31.

A first partial section 26 of the fiber feeding duct 19 is located in a projection 25 of the opening roller housing 30. This partial section 26 has an inlet cross-section 27 which corresponds to the working width (B) of the opening roller 28 which, on its circumference, is equipped with its mounting consisting of teeth or needles. The fiber feeding duct 19 is then continued by a section 18 which is provided in the cover 14. In a manner not shown in detail, the cover 14 is movably guided in such a manner that it rests on the projection 25 of the opening roller housing 30 by means of a sliding surface 24 and extends the partial section 26 of the fiber feeding duct 19 by means of the partial section 18 of the cover 14 in a straight line.

The mouth 20 of the fiber feeding duct 19 which is disposed opposite the sliding wall 8 of the rotor is directed into the interior of the rotor obliquely and by means of a tangential component. The fiber feeding duct 19 tapers from the start 27 to the mouth 20 at which a bundling effect is to be achieved. The fibers fed by the fiber feeding duct 19 slide on the sliding wall 8 into the fiber collecting groove 9, while they are additionally stretched and adjusted to extend in parallel. The fibers are withdrawn as a yarn by way of a yarn withdrawal nozzle 22 which is fastened to the projection 16 coaxially with respect to the rotor, this yarn having received a twist as a result of the rotation of the rotor 2. A yarn withdrawal duct 23 leads from this yarn withdrawal nozzle 22 to the outside where the spun yarn is withdrawn by means of a withdrawal device which is not shown and is guided to a wind-up device which is also not shown.

In order to achieve an air flow which is as high as possible particularly in the area of the start 27 of the fiber feeding duct 19 without having to significantly increase the vacuum applied in the vacuum chamber 4, a bypass opening 21 is connected to the fiber feeding duct 19. This bypass opening 21 is a bore which is disposed in the area of the opening 13 of the rotor housing 5 and is therefore connected with the vacuum chamber 4. The bypass opening 21 has a relatively small cross-section which preferably is smaller than half the value of the cross-section of the mouth 20. The transport air flow which arrives in the rotor 2 flows partly off by way of the overflow gap 17, while another part is transported away by way of the ventilating bores 12.

The mouth 20 of the fiber feeding duct 19 has a preferably round cross-section of maximally 20 $mm^2$, so that a good bundling of the fibers is obtained so that the fibers arrive on the sliding surface 8 in a narrowly delimited area which maintains a sufficient distance from the fiber collecting groove 9 as well as from the open edge 7.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for open-end rotor spinning including an opening roller, a spinning rotor, and a fiber feeding duct connecting the opening roller and the spinning rotor, the fiber feeding duct starting at the circumference of the opening roller with a cross-section adapted to a working width of the opening roller and tapering to its mouth which is disposed opposite a sliding surface of the spinning rotor which expands conically toward a fiber collecting groove which is followed by a rotor bottom by means of which the rotor is fastened on a shaft, the mouth of the fiber feeding duct being disposed in a projection projecting into the rotor, this projection, together with the open edge of the rotor, forming an overflow gap for the transport air and being part of a cover which covers a rotor housing receiving the rotor and connected to a vacuum source, wherein the fiber collecting groove of the rotor has a diameter of maximally 33 mm, wherein the mouth of the fiber feeding duct has a cross-section of maximally 20 $mm^2$, wherein the fiber feeding duct is provided with a bypass opening connected to a vacuum source in an area located outside the rotor for facilitating an increase in the flow of transport air flow in the fiber feeding duct upstream of the rotor, and wherein the rotor bottom is provided with ventilating bores.

2. An arrangement according to claim 1, wherein the bypass opening is connected with the rotor housing.

3. An arrangement according to claim 2, wherein the bypass opening has a cross-section which is between one-half and the total cross-section of the mouth of the fiber feeding duct.

4. An arrangement according to claim 3, wherein the ventilating bores of the rotor are arranged to be sloped with respect to the rotor axis in such a manner that their start, on the inside in the rotor, is located on a smaller radius than their ends located on the outside at the rotor.

5. An arrangement according to claim 2, wherein the ventilating bores of the rotor are arranged to be sloped with respect to the rotor axis in such a manner that their start, on the inside in the rotor, is located on a smaller radius than their ends located on the outside at the rotor.

6. An arrangement according to claim 1, wherein the bypass opening has a cross-section which is between one-half and the total cross-section of the mouth of the fiber feeding duct.

7. An arrangement according to claim 6, wherein the ventilating bores of the rotor are arranged to be sloped with respect to the rotor axis in such a manner that their start, on the inside in the rotor, is located on a smaller radius than their ends located on the outside at the rotor.

8. An arrangement according to claim 1, wherein the ventilating bores of the rotor are arranged to be sloped with respect to the rotor axis in such a manner that their start, on the inside in the rotor, is located on a smaller radius than their ends located on the outside at the rotor.

* * * * *